US005880074A

United States Patent [19]

Dishong et al.

[11] Patent Number: 5,880,074

[45] Date of Patent: Mar. 9, 1999

[54] ADDITIVE CONCENTRATES CONTAINING MIXTURES OF ORGANIC DILUENTS AND ESTERIFIED CARBOXY-CONTAINING INTERPOLYMERS AND LUBRICANTS CONTAINING THEM

[76] Inventors: Dennis M. Dishong, 4531 Wilburn Dr., South Euclid, Ohio 44121; James L. Sumiejski, 8012 Hackberry Dr., Mentor, Ohio 44060

[21] Appl. No.: 780,975

[22] Filed: Jan. 9, 1997

[51] Int. Cl.[6] ..... C10M 145/00

[52] U.S. Cl. ..... 508/472; 508/470

[58] Field of Search ..... 508/466, 468, 508/469, 470, 472

[56] References Cited

U.S. PATENT DOCUMENTS

| | | | |
|---|---|---|---|
| 3,449,250 | 6/1969 | Fields | 508/291 |
| 3,956,149 | 5/1976 | Coleman | 508/467 |
| 5,026,496 | 6/1991 | Takigawa | 508/472 |

FOREIGN PATENT DOCUMENTS

| | | |
|---|---|---|
| 0604125 A1 | 6/1994 | European Pat. Off. . |
| 0747466 A1 | 6/1996 | European Pat. Off. . |

*Primary Examiner*—Jacqueline V. Howard
*Assistant Examiner*—Cephia D. Toomer
*Attorney, Agent, or Firm*—Joseph P. Fischer; James L. Cordek

[57] ABSTRACT

Additive concentrates comprising from at least one organic diluent selected from the group consisting of naphthenic oils and synthetic oils and from about 95% to about 50% by weight of an ester as defined herein are useful to prepare lubricating oils having good viscosity index and which also have exceptional low temperature characteristics.

22 Claims, No Drawings

ADDITIVE CONCENTRATES CONTAINING MIXTURES OF ORGANIC DILUENTS AND ESTERIFIED CARBOXY-CONTAINING INTERPOLYMERS AND LUBRICANTS CONTAINING THEM

FIELD OF THE INVENTION

This invention relates to additive concentrates comprising mixtures of organic diluents and esterified carboxy-containing interpolymers and to lubricating compositions containing such mixtures. More particularly, this invention relates to mixtures of naphthenic or synthetic oils and esterified interpolymers derived from low molecular weight olefin or vinyl aromatic compounds and alpha, beta-unsaturated acylating agent, such interpolymers being esterified with aliphatic alcohols and, optionally, neutralized with amino compounds having about one primary or secondary amino group. The resulting mixtures are particularly useful as viscosity improvers having good low temperature characteristics.

BACKGROUND OF THE INVENTION

The viscosity of oils of lubricating viscosity is generally dependent upon temperature. As the temperature of the oil is increased, the viscosity usually decreases, and as the temperature is reduced, the viscosity usually increases.

The function of a viscosity improver is to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved.

Viscosity improvers are usually polymeric materials and are often referred to as viscosity index improvers.

Ester group containing polymers are well-known additives for improving the fluidity characteristic of lubricating oils. Polyacrylate, particularly polymethacrylate ester polymers, and esterified carboxy-containing interpolymers are well-known and are widely used for this purpose.

Dispersants are also well-known in the lubricating art. Dispersants are employed in lubricants to keep impurities, particularly those formed during operation of machinery, in suspension rather than allowing them to deposit on the surfaces of parts contacted by the lubricant.

Multifunctional additives that provide both viscosity improving properties and dispersant properties are likewise known in the art. Such products are described in numerous publications including Dieter Klamann, "Lubricants and Related Products", Verlag Chemie Gmbh (1984), pp 185–193); C. V. Smalheer and R. K. Smith "Lubricant Additives", Lezius-Hiles Co. (1967); M. W. Ranney, "Lubricant Additives", Noyes Data Corp. (1973)), pp 92–145, M. W. Ranney, "Lubricant Additives, Recent Developments", Noyes Data Corp. (1978), pp 139–164; and M. W. Ranney, "Synthetic Oils and Additives for Lubricants", Noyes Data Corp. (1980), pp 96–166. Each of these publications is hereby expressly incorporated herein by reference.

It is desirable that the viscosity improver or dispersant viscosity improver not adversely affect the low-temperature viscosity of the lubricant containing same. Frequently, while many viscosity improvers or dispersant viscosity improvers enhance the high temperature viscosity characteristics of lubricating oil, that is, they reduce the loss of viscosity with increasing temperature, low temperature properties of the treated lubricant become worse.

One of the major requirements for automatic transmission fluids has been improved low temperature performance as demonstrated by a maximum Brookfield viscosity of 20,000 centipoise at −40° C. The viscosity modifier can have a major impact on the low temperature performance. Such characteristics are also desirable in other applications such as in gear lubricants. The copolymers of this invention are also useful in many other lubricating oil compositions including, but not limited to engine oils, hydraulic oils, industrial oils, etc.

Accordingly, it is desirable, and a primary object of this invention, to provide compositions that reduce the extent of loss of viscosity at high temperatures while not adversely increasing the low temperature viscosity of lubricating oil compositions.

A particular object is to provide novel additive concentrates containing multi-purpose lubricant additives.

A more specific object is to provide multi-purpose additives directed to improving the viscosity and dispersant properties of a lubricating composition.

Yet another object is to provide lubricants having improved dispersant and viscosity properties.

Another object is to provide additive concentrates for lubricants, which additive concentrates contain esterified interpolymers that are resistant to shearing.

Other objects will in part be obvious in view of this disclosure and will in part appear hereinafter.

Various pour point depressants, additives which reduce the temperature at which oil will flow freely, have been developed and those to reach the commercial market have primarily been organic polymers, although some monomeric substances such as tetra (long chain alkyl) silicates, phenyl tristearyloxy-silane, and pentaerythritol tetrastearate have been shown to be effective. Presently available commercial pour point depressants are believed to be represented by the following types of polymeric materials: polymethacrylates, for example, copolymers of various chain length alkyl methacrylates (see, for example, U.S. Pat. No. 2,655,479); polyacrylamides (see, for example, U.S. Pat. No. 2,387, 501); Friedel-Crafts condensation products of chlorinated paraffin wax with naphthalene (see, for example, U.S. Pat. Nos. 1,815,022 and 2,015,748); Friedel-Crafts condensation products of chlorinated paraffin wax with phenol (see, for example, U.S. Pat. No. 2,191,498); and vinyl carboxylate, such as dialkyl fumarate copolymers (see, for example, U.S. Pat. Nos. 2,666,746; 2,721,877 and 2,721,878).

Esters of maleic anhydride/alpha-olefin copolymers have been suggested as pour point depressants. For example, U.S. Pat. No. 2,977,334 describes the use of copolymers of maleic anhydride and ethylene which are esterified with low or high molecular weight alcohols and/or amidized with an amine. These resins are described as being useful as pour point modifiers, gelling agents, thickeners, viscosity improvers, etc., for mineral and synthetic oils including functional fluids and lubricating oils. U.S. Pat. No. 2,992, 987 describes a class of lubricant additives useful as pour point depressants which are ethylene-maleic anhydride copolymers esterified to 80% or more, preferably 90–100%, with a mixture of straight-chain saturated hydrocarbon alcohols having from 8 to 24 carbon atoms. The unesterified carboxylic groups can be left unreacted or can be reacted with such materials as ethylene or propylene oxide alcohol esters, or lower-dialkyl-amino-lower-alkylene-amines. U.S. Pat. Nos. 3,329,658 and 3,449,250 describe copolymers of maleic anhydride and alpha-olefins such as ethylene, propylene, isobutylene or vinyl aromatic compounds such as styrene as being useful dispersancy and detergency additives for oils, as well as pour point depressants and viscosity index improvers. The copolymer is esterified to about 30 to about 95% with aliphatic alcohols or mixtures of alcohols having from 10 to 20 carbon atoms, and the remaining carboxyl groups are reacted with an amine of the following formula:

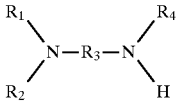

where $R_1$ and $R_2$ are selected from the group consisting of aliphatic hydrocarbon radicals having from 1 to 4 carbon atoms and the cyclohexyl radical, $R_3$ is an aliphatic hydrocarbon radical having from 2 to 4 carbon atoms, and $R_4$ is selected from the class consisting of hydrocarbon atom and aliphatic hydrocarbon radicals having from 1 to 4 carbon atoms.

U.S. Pat. Nos. 3,702,300 and 3,933,761 describe carboxy-containing interpolymers in which some of the carboxy radicals are esterified and the remaining carboxy radicals are neutralized by reaction with a polyamino compound having one primary or secondary amino group and at least one mono-functional amino group, and indicate that such interpolymers are useful as viscosity index improving and anti-sludge agents in lubricating compositions and fuels. The patentee indicates that it is critical that the mixed esters described in these patents include both relatively high molecular weight carboxylic ester groups having at least eight aliphatic carbon atoms in the ester radical and relatively low molecular weight carboxylic ester groups having no more than seven aliphatic carbon atoms in the ester radical.

U.S. Pat. No. 4,604,221 relates to interpolymers similar to those described in the aforementioned '300 and '761 patents, except the ester groups contain at least 8 carbon atoms in the ester radical.

U.S. Pat. No. 5,124,059 describes esters of similar interpolymers characterized by the presence within its polymeric structure of the following groups which are derived from carboxy groups of said interpolymer:

(A) at least one carboxylic ester group having at least 8 aliphatic carbon atoms in the ester group;

(B) at least one carboxylic ester group having an ester group of the formula $$\mathrm{RO(\overset{R'}{\overset{|}{C}}HCH_2O)_y(CH_2CH_2O)_x-}$$

wherein R is a hydrocarbyl group of about 1 to about 50 carbon atoms, R' is a hydrocarbyl group of about 1 to about 50 carbon atoms, y is a number in the range of zero to about 50 and z is a number in the range of zero to about 50 with the proviso that both y and z cannot be zero; and optionally (C) at least one carboxylic ester group having no more than 7 aliphatic carbon atoms in the ester group.

U.S. Pat. No. 3,956,149 issued to Coleman relates to a lubricant or fuel composition containing a nitrogen-containing ester of a carboxy-containing interpolymer.

U.S. Pat. No. 3,959,159 issued to Coleman relates to lubricating compositions containing a nitrogen-containing mixed ester of a carboxy-containing interpolymer.

U.S. Pat. No. 4,284,414 issued to Bryant relates to a crude oil composition containing mixed alkyl esters of a carboxy-containing interpolymer.

U.S. Pat. No. 4,180,637 issued to Evani et al. relates to a process for preparing a low molecular weight carboxy-containing copolymer.

U.S. Pat. No. 4,200,720 issued to Evani et al. relates to a process for preparing a low molecular weight carboxy-containing interpolymer.

U.S. Pat. No. 3,085,994 issued to Muskat relates to a carboxy-containing interpolymer.

U.S. Pat. No. 3,388,106 issued to Muskat relates to a process for making a carboxy-containing interpolymer.

U.S. Pat. No. 3,392,155 issued to Muskat relates to a polyoxy alkylene glycol ester of a carboxy-containing interpolymer.

U.S. Pat. No. 5,157,088 relates to nitrogen-containing esters of carboxy-containing interpolymers having relatively low inherent viscosity.

U.S. Pat. No. 4,088,589 relates to lubricating oils blended from petroleum distillates and, if desired, a bright stock containing waxy or wax-like components and modified by the presence of copolymeric ethylene-higher alpha-olefins viscosity index improving agents, having their low temperature performance improved when said copolymer contains a minor weight proportion of ethylene by the addition of from 0.15 to 1%, based on the total weight of said lubricating oil composition of a combination of pour point depressants comprising: (a) from about 0.05 to about 0.75 wt. % of an oil-soluble condensation product of a chlorinated wax of from 10 to 50 carbon atoms and a mono- or dinuclear aromatic compound; and (b) from 0.05 to 0.75 wt. % of an oil soluble polymer of $C_{10-18}$ alkyl acrylate and/or an interpolymer of a vinyl alcohol ester of a $C_2$ to $C_{18}$ alkanoic acid and di-($C_4$–$C_{18}$ alkyl) fumarate.

The Society of Automotive Engineers (SAE) has issued a standard, J-300 (December 1995), which defines limits for classification of engine lubricating oils in rheological terms. This standard contains limits for various engine oil viscosity grades. Also included in the standard are discussions of low temperature and of high temperature test methods.

A review of developments in low temperature performance is presented by Schaub, "A History of ASTM Accomplishments in Low Temperature Engine Oil Rheology" in "Low Temperature Lubricant Rheology Measurement and Relevance to Engine Operation", R. B. Rhodes, ed., ASTM, Philadelphia, Pa. (1992), pp 1–19.

SUMMARY OF THE INVENTION

Additive concentrates comprising mixtures of organic diluents and esterified carboxy-containing interpolymers are provided in accordance with the present invention, which when added to lubricant compositions provide such lubricant compositions with superior low temperature properties as well as other desirable properties including viscosity index improvement. These ester containing additive concentrates, particularly the nitrogen-containing esters, also enhance the dispersion of other additives as well as contaminants (e.g., dirt, water, metallic particles, etc.) in the lubricating compositions to which they are added. These ester containing additive concentrates also enhance the flow characteristics of additive concentrates to which they are added.

Broadly stated, the present invention contemplates the provision of an additive concentrate comprising from about 5 to about 95% by weight of at least one substantially inert organic diluent selected from the group consisting of naphthenic oils and synthetic oils, and from about 95 to about 5% by weight of an ester derived from a carboxy-containing interpolymer having a reduced specific viscosity (RSV) of from about 0.05 to about 0.35, said interpolymer being derived from at least two monomers, (i) one of said monomers being at least one of an aliphatic olefin containing from 2 to about 30 carbon atoms and a vinyl aromatic monomer and (ii) the other of said monomers being at least one alpha, beta-unsaturated acylating agent, said ester being characterized by the presence within its polymeric structure of each of the following groups which are derived from the carboxy groups of said interpolymer:

(A) from about 20 to about 70 mole % based on moles of carboxyl groups in said interpolymer, of ester groups containing from about 12 to about 19 carbon atoms.

(B) from about 80 to about 30 mole %, based on moles of carboxyl groups in said interpolymer, of ester groups containing from 8 to about 11 carbon atoms, and optionally, (C) up to about 20 mole %, based on moles of carboxyl groups in said interpolymer, of ester groups containing from 2 to 7 carbon atoms.

In a further embodiment, the ester further comprises (D) a carbonyl-amino group derived from an amino compound having an average of from 1 to about 1.1 primary or secondary amino group, wherein the molar ratio of (A):(B):(C):(D) is (20–70):(80–30):(0–20):(0.1–10).

Lubricant compositions comprising the additive concentrates comprising the foregoing esterified interpolymers are also provided in accordance with the present invention.

DETAILED DESCRIPTION OF THE PREFERRED EMBODIMENTS

According to the present invention an additive concentrate suitable for use as a dispersant-viscosity improver for preparing lubricating oil compositions comprises esterified interpolymers derived from a mixture of monomers as set forth in greater detail hereinabove and hereinbelow. The invention also contemplates lubricating oil compositions containing the additive concentrate.

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is, they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

As used in the specification and in the appended claims, the singular forms "a", "an" and "the" include plural unless the context clearly dictates otherwise. Thus, for example, reference to a polymer includes mixtures of polymers, reference to an acylating agent includes mixtures of acylating agents, etc.

In the context of this invention the term "interpolymer" means a polymer derived from two or more different monomers.

As used in the specification and claims, the term carboxy-containing refers to polymers which are prepared using a carboxy-containing monomer. The carboxy-containing monomer is polymerized with other monomers to form the carboxy-containing interpolymer. Since the carboxy-containing monomer is incorporated into the polymer backbone, the carboxy groups extend from the polymer backbone, e.g., the carboxy groups are directly attached to the polymer backbone.

As described above, the invention relates to additive concentrates comprising a mixture of organic diluent and esterified carboxy-containing interpolymers. The mixture may comprise amounts ranging from about 1–99% by weight, preferably from about 5 to about 95% by weight, and more often from about 15 to about 85% by weight of esters having carboxylic ester group (A), and from about 99–1% by weight, preferably from about 95 to about 5% by weight, and more often from about 85 to about 15% by weight of esters having carboxylic ester groups (B) and (C).

In reference to the size of the ester groups, it is pointed out that an ester group is represented by the formula $$-C(O)(OR)$$

and that the number of carbon atoms in an ester group is thus the combined total of the carbon atom of the carbonyl group and the carbon atoms of the (OR) group. Thus, methyl methacrylate contains two carbon atoms in the ester group. A butyl ester contains five carbon atoms in the ester group.

An essential element of the present invention is the presence of the mixture of organic diluent and esterified interpolymers. The mixture is critical to the improved low temperature properties.

One optional element of the present invention is the presence of up to about 20 mole %, based on moles of carboxyl group in the interpolymer, of ester groups containing from 2 to 7 carbon atoms.

Another optional element of the present invention is the presence of an amino group derived from amino compounds, and particularly those having an average of from 1 to about 1.1 primary or secondary amino groups. In one embodiment the amino compound is a polyamino compound having at least one mono-functional amino group. Such amino groups, when present in the esters of the present invention in the proportion stated above, enhance the dispersant properties of such esters in lubricant compositions and dispersability of additives for lubricant compositions.

When the mixture contains a nitrogen-containing ester, an essential element is the extent of esterification in relation to the extent of neutralization of the unesterified carboxy groups of the carboxy-containing interpolymer through the conversion thereof to amino-containing groups. The molar ratio of the carboxy groups of said interpolymer that are esterified to the carboxy groups neutralized through the conversion thereof to amino-containing groups is generally in the range of about 85:15 to about 99:1. A preferred ratio is 95:5. It should be noted that the linkage described as the carbonyl-amino group may be salt, imide, amide, amidine and inasmuch as any such linkage is contemplated within the present invention, the term "carbonyl amino" is thought to be a convenient, generic expression useful for the purpose of defining the inventive concept. In a particularly advantageous embodiment of the invention such linkage is imide or predominantly imide.

Still another important element of the present invention is the molecular weight of the carboxy-containing interpolymer before esterification. Whenever reference is made in this application to RSV or reduced specific viscosity, the reference is to the interpolymer before it is esterified. For convenience, the molecular weight is expressed in terms of the "reduced specific viscosity" of the interpolymer which is a widely recognized means of expressing the molecular size of a polymeric substance. As used herein, the reduced specific viscosity (abbreviated RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 100 ml. of acetone and the viscosity of acetone at 30°±0.02° C. For purpose of computation by the above formula, the concentration is adjusted to 0.4 gram of the interpolymer per 100 ml. of acetone. A more detailed discussion of the reduced specific viscosity, also known as the reduced viscosity, as well as its relationship to the average molecular weight of an interpolymer, appears in Paul J. Flory, *Principles of Polymer Chemistry* (1953 Edition) pages 308 et seq; Mark, Bikales, Overberger and Menges, Eds., *Encyclopedia of Polymer Science and Engineering,* 2nd ed., Wiley Interscience (1988), V. 14, pp 463–465; and F. W. Billmeyer, *Textbook of Polymer Science*, Wiley Publishing (1962), pp 79–85.

The carboxy-containing interpolymers useful in preparing the esters useful in the invention are copolymers, terpolymers, and other interpolymers of (i) at least one aliphatic olefin monomer or vinyl aromatic monomer, and (ii) at least one alpha, beta-unsaturated carboxylic acylating agent, typically a carboxylic acid or derivative thereof. The derivatives of the carboxylic acid are derivatives which are polymerizable with the olefin monomers or vinyl aromatic monomers (i), and as such may be the esters, especially lower alkyl esters, e.g., those containing from 2 to 7 carbon atoms in the ester alkyl group, especially 2 carbon atoms, halides and anhydrides of the acids. The molar ratio of (i) to (ii) ranges from about 1:2 to about 3:1, preferably about 1:1. The carboxy-containing interpolymer is prepared by polymerizing an aliphatic olefin or vinyl aromatic monomer with the alpha, beta-unsaturated carboxylic acid or derivative thereof.

Mixtures of two or more compatible (i.e., nonreactive to one another) interpolymers which are separately prepared are contemplated herein for use in the esterification reaction, if each has a RSV as above described. Thus, as used herein, and in the appended claims, the terminology "interpolymer" refers to either one separately prepared interpolymer or a mixture of two or more of such interpolymers. A separately prepared interpolymer is one in which the reactants and/or reaction conditions are different from the preparation of another interpolymer.

While interpolymers having RSV from about 0.05 to about 0.35 are contemplated in the present invention, the preferred interpolymers are those having RSV of from about 0.08, often from 0.12 or 0.2 to about 0.3, often to 0.25. In another embodiment, the RSV ranges from about 0.05 to about 0.25, in still another embodiment, from about 0.08 to about 0.15. Interpolymers having RSV of from about 0.08 to about 0.25 or from about 0.10 to about 0.2 are particularly useful.

Aliphatic Olefins

Suitable aliphatic olefin monomers that are useful in the preparation of the interpolymers of the invention are mono-olefins of about 2 to about 30 carbon atoms. Included in this group are internal olefins (i.e., wherein the olefinic unsaturation is not in the "1" or alpha position) and mono-1-olefins or alpha-olefins. Alpha olefins are preferred. Exemplary olefins include ethylene, propylene, 1-butene, isobutene, 1-pentene, 2-methyl-1-butene, 3-methyl-1-butene, 1-hexene, 1-heptene, 1-octene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, 1-pentacosene, 1-hexacosene, 1-octacosene, 1-nonacosene, etc. Commercially available alpha-olefin can also be used. Exemplary alpha-olefin mixtures include $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, et Additionally, $C_{30}$+ alpha-olefin fractions such as those available from Conoco, Inc. can be used. Preferred olefin monomers include ethylene, propylene and 1-butene.

The mono-olefins can be derived from the cracking of paraffin wax. The wax cracking process yields both even and odd number $C_{6-20}$ liquid olefins of which 85 to 90% are straight chain 1-olefins. The balance of the cracked wax olefins is made up of internal olefins, branched olefins, diolefins, aromatics and impurities. Distillation of the $C_{6-20}$ liquid olefins obtained from the wax cracking process yields fractions (e.g., $C_{15-18}$ alpha-olefins) which are useful in preparing the interpolymers of this invention.

Other mono-olefins can be derived from the ethylene chain growth process. This process yields even numbered straight chain 1-olefins from a controlled Ziegler polymerization.

Other methods for preparing the mono-olefins of this invention include chlorination-dehydrochlorination of paraffin and catalytic dehydrogenation of paraffins.

The above procedures for the preparation of mono-olefins are well known to those of ordinary skill in the art and are described in detail under the heading "Olefins" in the Encyclopedia of Chemical Technology, Second Edition, Kirk and Othmer, Supplement, pages 632–657, Interscience Publishers, Div. of John Wiley and Son, 1971, which is hereby incorporated by reference for its relevant disclosures pertaining to methods for preparing mono-olefins.

Vinyl Aromatic Monomers

Suitable vinyl aromatic monomers which can be polymerized with the alpha, beta-unsaturated acylating agents include styrene and the substituted styrenes although other vinyl aromatic monomers can also be used. The substituted styrenes include styrenes that have halo-, amino-, alkoxy-, carboxy-, hydroxy-, sulfonyl-, hydrocarbyl- wherein the hydrocarbyl group has from 1 to about 12 carbon atoms and other substituents. Exemplary of the hydrocarbyl-substituted styrenes are alpha-methylstyrene, para-tert-butylstyrene, alpha-ethylstyrene, and para-lower alkoxy styrene. Mixtures of two or more vinyl aromatic monomers can be used. Styrene is preferred.

Alpha,Beta-Unsaturated Acylating Agent

Suitable alpha, beta-unsaturated acylating agents useful in the preparation of the interpolymers are represented by carboxylic acids, anhydrides, halides, or lower alkyl esters thereof. These include mono-carboxylic acids (e.g., acrylic acid, methacrylic acid, etc. or lower alkyl esters thereof, as well as dicarboxylic acids, anhydrides or lower alkyl esters thereof wherein a carbon-to-carbon double bond is in an alpha,beta- position to at least one of the carboxy functions (e.g., itaconic acid, anhydride or lower esters thereof, α-methylene glutaric acid or esters thereof,) and preferably in an alpha, beta-position to both of the carboxy functions of the alpha, beta-dicarboxylic acid, anhydride or the lower alkyl ester thereof (e.g., maleic acid or anhydride, fumaric acid, or lower alkyl, i.e., those containing no more than 7 carbon atoms, esters thereof). Normally, the carboxy functions of these compounds will be separated by up to about 4 carbon atoms, preferably about 2 carbon atoms.

A class of preferred alpha,beta-unsaturated dicarboxylic acid, anhydrides or the lower alkyl esters thereof, includes those compounds corresponding to the formulae:

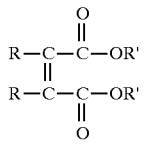

(I)

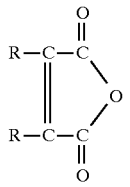

(II)

(including the geometric isomers thereof, i.e., cis and trans) wherein each R is independently hydrogen; halogen (e.g., chloro, bromo, or iodo); hydrocarbyl or halogen-substituted hydrocarbyl of up to about 8 carbon atoms, preferably alkyl, alkaryl or aryl; (preferably, at least one R is hydrogen, more preferably, both R are hydrogen); and each R' is independently hydrogen or lower alkyl of up to about 7 carbon atoms (e.g., methyl, ethyl, butyl or heptyl). These alpha, beta-unsaturated dicarboxylic acids, anhydrides or alkyl esters thereof contain a total carbon content of up to about 25 carbon atoms, normally up to about 15 carbon atoms. Examples include maleic acid or anhydride; benzyl maleic anhydride; chloro maleic anhydride; heptyl maleate; itaconic acid or anhydride; ethyl fumarate; fumaric acid, mesaconic acid; ethyl isopropyl maleate; isopropyl fumarate; hexyl methyl maleate; phenyl maleic anhydride and the like. These and other alpha, beta-unsaturated dicarboxylic compounds are well known in the art. Maleic anhydride, maleic acid and fumaric acid and the lower alkyl esters thereof are preferred. Interpolymers derived from the mixtures of two or more of any of these can also be used.

Alternatively, the (OR') group in the above formula may contain more than 7 carbon atoms, being derived from a mixture of alcohols, some containing over 7 carbon atoms, and in such instances, the ester group may remain attached to the carboxy group during and after formation of the interpolymer. This procedure provides a method of introducing the desirable ester groups initially, and eliminates the need to introduce the ester groups in a separate subsequent step.

In another preferred embodiment, the alpha,beta- unsaturated agent comprises a mixture of two or more components. Thus, interpolymers prepared from reaction mixtures wherein (ii) comprises 2 or more, usually up to 4, preferably 2, different alpha-beta unsaturated acylating agents are contemplated. A non-limiting example might be a mixture of maleic acid or anhydride with esters of acrylic acids. Other mixtures are contemplated.

When (ii) comprises a mixture of monomeric components, they may be present in any amounts relative to one another. However, it is preferred that one of the components is present in a major amount, i.e., more than 50 mole % of the mixture. In an especially preferred embodiment, the total amount of additional components is present in amounts ranging from about 0.005 to about 0.3 moles, per mole of major component, more often from about 0.01 to about 0.15 moles, preferably from about 0.03 to about 0.1 moles minor component per mole of major component.

Examples of preferred mixtures of acylating agents are, maleic acid or anhydride with esters of acrylic acids, especially esters of methacrylic acid. Preferred esters are lower alkyl esters. An especially preferred mixture of acylating agents is one containing maleic anhydride and lower alkyl esters of methacrylic acid. Especially preferred is a mixture of maleic anhydride and methyl or ethyl, preferably methyl, methacrylate.

Particularly preferred esters used in the compositions of this invention are those of interpolymers made by reacting maleic acid, or anhydride or the lower esters thereof with styrene. Of these particularly preferred interpolymers, those which are made of maleic anhydride and styrene and have a RSV in the range of about 0.05 to about 0.35, preferably about 0.08 to about 0.25, are especially useful. Of these latter preferred interpolymers, copolymers of maleic anhydride and styrene having a molar ratio of the maleic anhydride to styrene of about 1:1 are especially preferred. They can be prepared according to methods known in the art, as for example, free radical initiated (e.g., by benzoyl peroxide) solution polymerization. Examples of such suitable interpolymerization techniques are described in U.S. Pat. Nos. 2,938,016; 2,980,653; 3,085,994; 3,342,787; 3,418,292; 3,451,979; 3,536,461; 3,558,570; 3,702,300; 3,723,375; 3,933,761; 4,284,414, and 4,604,221. These patents are incorporated herein by reference for their teaching of the preparation of suitable maleic anhydride and styrene containing interpolymers. Other preparative techniques are known in the art.

The carboxy-containing interpolymers may also be prepared using one or more additional interpolymerizable comonomers. The additional comonomer is present in relatively minor proportions. Generally, the total amount is less than about 0.3 mole, usually less than about 0.15 mole of additional comonomers for each mole of either the olefin or the alpha,beta- unsaturated carboxylic acylating agent. Examples of additional comonomers include acrylamides, acrylonitrile, vinyl pyrrolidinone, vinyl pyridine, vinyl ethers, and vinyl carboxylates. In one embodiment, the additional comonomers are vinyl ethers or vinyl carboxylates.

Vinyl ethers are represented by the formula $R_1$—CH═CH—$OR_2$ wherein each $R_1$ is hydrogen or a hydrocarbyl group having 1 to about 30, or to about 24, or to about 12 carbon atoms and $R_2$ is a hydrocarbyl group having 1 to about 30 carbon atoms, or to about 24, or to about 12. Examples of vinyl ethers include methyl vinyl ether, propyl vinyl ether, 2-ethylhexyl vinyl ether and the like.

The vinyl ester of a carboxylic acid may be represented by the formula $R_3$CH═CH—O(O)$CR_4$ wherein $R_3$ is a hydrogen or hydrocarbyl group having from 1 to about 30, or to 12 carbon atoms, or just hydrogen, and $R_4$ is a hydrocarbyl group having 1 to about 30, or to about 12, or to about 8. Examples of vinyl esters include vinyl acetate, vinyl 2-ethylhexanoate, vinyl butanoate, vinyl crotonate.

The molecular weight (i.e., RSV) of such interpolymers can be adjusted to the range required in this invention, if necessary, according to conventional techniques, e.g., control of the reaction conditions.

Preferred interpolymers are prepared from a vinyl aromatic monomer and an aliphatic carboxylic acid or anhydride and esters thereof.

Preferably, the vinyl aromatic monomer is styrene or a substituted styrene (either ring substituted or substituted on the aliphatic —C═C group), most preferably, styrene.

Preferably, the aliphatic carboxylic acid or anhydride and esters thereof is at least one member selected from the group consisting of maleic acid or anhydride, itaconic acid or anhydride, fumaric acid, α-methylene glutaric acid, acrylic acid, methacrylic acid or an ester thereof.

In one preferred embodiment the interpolymer is derived from styrene and maleic anhydride. In another preferred embodiment the interpolymer is derived from styrene, maleic anhydride and methacrylic acid or an ester thereof.

In the latter preferred embodiment, the mole ratio of styrene:maleic anhydride:methacrylic acid or ester thereof ranges from about (1–3):(2–1):(0.01–0.3), preferably from about (1–2):(1.5–1):(0.01–0.03), more preferably from 1:1:(0.03–0.08), most preferably from 1:1:0.05.

The Diluent

As noted hereinabove, the additive concentrates of this invention contain a diluent. Often they are prepared in the presence of the diluent. The diluent may also be added to a substantially diluent-free copolymer, usually by dissolving or dispersing the substantially diluent-free polymer in an appropriate diluent, or by adding a higher boiling point diluent to an interpolymer containing a lower boiling point diluent such as toluene and removing the lower boiling point diluent by, e.g., distillation.

The diluent is a naphthenic oil or a synthetic oil. In an especially preferred embodiment the diluent consists essentially of hydrotreated naphthenic oil.

The diluent may also be a synthetic oil. Common synthetic oils are ester type oils, polyolefin oligomers or alkylated benzenes.

Mixtures of naphthenic and synthetic oil diluents are contemplated.

The diluent-containing copolymers of this invention are referred to herein as additive concentrates. Such additive concentrates are then added, along with other desirable performance-improving additives, to an oil of lubricating viscosity to prepare the finished lubricant composition.

The additive concentrates preferably comprise from about 5 to about 95% by weight of copolymer, preferably from 35% to about 80% by weight, and from about 5% to about 95% by weight of diluent, preferably from about 20% to about 65% by weight of diluent.

Selection of diluents having particular characteristics leads to enhanced performance of dispersant-viscosity improvers of this invention. For example, lubricating oil compositions comprising additive concentrates containing certain diluents together with the esterified interpolymers of this invention have enhanced low temperature characteristics. Particularly valuable are lubricating oil compositions that display excellent viscosity characteristics at very low temperatures, for example from −5° C. to −40° C.

The naphthenic and synthetic diluents that impart surprising and exceptional low temperature performance when used in conjunction with the dispersant viscosity improvers of this invention, have in common very low viscosity at very low temperatures. In particular they all display Brookfield viscosities (expressed in centipoise) at −26° C. ranging from about 50 to about 400, more preferably from about 80 to about 200. At −40° C. useful oils have Brookfield viscosities (expressed in centipoise) ranging from about 100 to about 1500, more preferably from about 125 to about 600. Brookfield viscosities are determined employing ASTM Procedure D-2983 described in greater detail hereinafter. These particularly useful diluents display viscosities (ASTM Procedure D-445) at 40° C. ranging from about 2.5 to about 6 centistokes and at 100° C. ranging from about 1 to about 2.5 centistokes.

Included among such useful diluents are naphthenic oils, hydrotreated naphthenic oils, and alkylated aromatics particularly alkylated benzenes having at least one alkyl group containing from about 8 to about 24 carbon atoms, preferably from 12 to about 18 carbon atoms. Especially useful are hydrotreated naphthenic oils examples being Risella G-07, Cross Oil Co.'s L-40, a 40 neutral hydrotreated naphthenic oil and L-60, which is a 60 neutral oil.

Low temperature viscosity (Brookfield Viscosity) of fluid lubricants is determined using ASTM Procedure 2983, Standard Test Method for Low Temperature Viscosity of Automotive Fluid Lubricants Measured by Brookfield Viscometer, which appears in the Annual Book of ASTM Standards, Section 5, ASTM, Philadelphia, Pa., USA. This procedure employs a Brookfield Viscometer which is described in the procedure. The device is available from Brookfield Engineering Laboratories, Stoughton, Mass., USA.

ASTM Procedure D-445 is described hereinafter.

The following examples serve to illustrate the preparation of the interpolymers used in this invention and are not intended as limiting thereof. Unless otherwise indicated, in the following examples as well as throughout the specification and in the appended claims, all parts and percentages are by weight and all temperatures in degrees Celsius. RSV values are for diluent-free polymers in deciliters per gram @ 30° C. Benzoyl peroxide is nominally 70% in $H_2O$. Percadox 16 is nominally 98–99% assay bis(4-t-butylcyclohexyl) peroxydicarbonate.

EXAMPLE 1

A styrene-maleic anhydride interpolymer is prepared by the following procedure. 176 parts of maleic anhydride are dissolved in 2641 parts of xylene. To this mixture at 105° C. is added first 188 parts of styrene. Then 1.83 parts benzoyl peroxide dissolved in 32 parts xylene are added over a 1.5 hour period. The mixture is maintained at 104°–106° C. for 4 hours, then is stripped to 150° C. at 200 torr. The resulting interpolymer has RSV of 0.25.

EXAMPLE 2

Heat 490 parts of maleic anhydride and 5000 parts of toluene to 100° C., then add one-half of an initiator of 2.13 parts of benzoyl peroxide in 500 parts of toluene. Add 520 parts styrene and the remaining initiator solution dropwise over 0.7 hour, then maintain at 100° C. for 4 hours. Theory RSV=0.30.

EXAMPLE 3

Heat 490 parts of fumaric acid and 5000 parts of toluene to 100° C., then add one-half of an initiator solution of 4.25 parts benzoyl peroxide in 500 parts toluene. Add 520 parts of styrene and the remainder of the initiator solution dropwise over 0.7 hour, then maintain temperature at about 100° C. for 4 hours by applying a vacuum to effect reflux. Theory RSV=0.23.

EXAMPLE 4

Mix and heat 490 parts of maleic anhydride and 5000 parts of xylene to 100° C., then add an initiator solution of 17 parts benzoyl peroxide and 500 parts xylene. Apply a vacuum to effect reflux. At 100° C. add 520 parts of styrene over 0.3 hour. The reaction is very exothermic. Maintain the reaction temperature at 100° C. for 4 hours after the addition is completed. Theory RSV=0.15.

EXAMPLE 5

Mix and heat 490 parts of maleic anhydride and 6900 parts of toluene to 100° C., then add one-half of an initiator solution of 14.3 parts benzoyl peroxide and 500 parts toluene. Then add remainder of the initiator solution and a mixture of 494 parts of styrene, 29.5 parts of alpha-methyl styrene and 25 parts of methyl methacrylate dropwise over 1.5 hours. Apply a vacuum to obtain reflux at 100° C. Maintain the reaction temperature at 100° C. for 4 hours. Theory RSV=0.14.

EXAMPLE 6

Mix and heat 490 parts of maleic anhydride and 6900 parts toluene to 100° C., then add one-half of an initiator solution of 14.3 parts of benzoyl peroxide and 500 parts toluene. Apply a vacuum to obtain reflux at 100° C. Add the remainder of the initiator solution and a mixture of 494 parts of styrene and 59 parts of alpha-methyl styrene dropwise over 1.5 hours. Maintain the reaction temperature at 100° C. for 4 hours. Theory RSV=0.15.

EXAMPLE 7

Using the same procedure as described in Example 6, polymerize 490 parts of fumaric acid with 520 parts of styrene and 29.5 parts of alpha-methyl styrene. Use 8.5 parts of benzoyl peroxide as an initiator and 7400 parts of toluene as a solvent. Theory RSV=0.20.

EXAMPLE 8

Repeat the procedure of Example 7 employing 7 parts of benzoyl peroxide as an initiator. Theory RSV=0.17.

EXAMPLE 9

Repeat the procedure of Example 7 employing 14.3 parts of benzoyl peroxide. Theory RSV=0.14.

EXAMPLE 10

Repeating the procedure of Example 7, polymerize 490 parts of maleic anhydride with 520 parts of styrene and 25 parts of methyl methacrylate using 4.3 parts of benzoyl peroxide. Theory RSV=0.26.

EXAMPLE 11

Repeat the procedure of Example 10 using 8.5 part increments of benzoyl peroxide. Theory RSV=0.13.

EXAMPLE 12

A reactor is charged with 1408 parts toluene and 100 parts maleic anhydride followed by heating to 95° C. With the batch refluxing at 94°–96° C. a first solution of 1.68 parts benzoyl peroxide in 51 parts toluene is charged followed by the simultaneous addition over 1.5 hours of solutions of 106.1 parts styrene with 5.1 parts methyl methacrylate and 1.68 parts benzoyl peroxide in 51 parts toluene, maintaining 94°–96° C. The batch is held at 94°–96° C. and 440–470 mm Hg. absolute pressure for four hours until at least 97% of maleic anhydride is reacted and the RSV @ 30° C. is 0.12–0.14.

EXAMPLE 13

Repeat the procedure of Example 10 using 50 parts of methyl methacrylate. 8.5 parts benzoyl peroxide and 7400 parts toluene. Theory RSV=0.15.

EXAMPLE 14

A reactor is charged with 794 parts $C_{9-11}$ substituted aromatic solvent, $N_2$ purge is begun, and the materials are heated to 65° C. whereupon 769 parts $C_{20-24}$ alpha-olefin and 251 parts maleic anhydride are added. The temperature is increased to 80°, a mixture of 35.7 parts Percadox 16 in 148 parts aromatic hydrocarbon is added and the materials are heated at 80°–87° C. until the batch contains less than 0.25% maleic anhydride.

Esterification

As noted hereinabove the esters used in the additive concentrates of this invention are characterized by the presence within its polymeric structure of each of the following groups which are derived from the carboxy groups of said interpolymer:

(A) from about 20 to about 70 mole % based on moles of carboxyl groups in said interpolymer, of ester groups containing from about 12 to about 19 carbons, (B) from about 80 to about 30 mole % based on moles of carboxyl groups in said interpolymer, of ester groups containing from about 8 to about 11 carbon atoms, and optionally, (C) up to about 20 mole % based on moles of carboxyl groups in said interpolymer, of ester groups containing from 2 to 7 carbon atoms.

In one embodiment, the ester comprises up to about 10 mole %, typically from 0.05 to about 10 mole %, based on moles of carboxyl groups in said interpolymer of ester groups containing from 2 to 7 carbon atoms, often up to about 5 carbon atoms.

Esterification (or transesterification, when the interpolymer contains ester groups) of the interpolymers can be accomplished by heating any of the interpolymers (having the requisite RSV) and the desired alcohol(s) and alkoxylate (s) under conditions typical for effecting esterification. Such conditions include, for example, a temperature of at least about 80° C., but more preferably from about 150° C. to about 350° C., provided that the temperature is maintained at a level below the decomposition temperature of the reaction mixture or products thereof. Water or lower alcohol is normally removed as the esterification proceeds. These conditions may optionally include the use of a substantially inert, normally liquid, organic solvent or diluent such as mineral oil, toluene, benzene, xylene or the like and an esterification catalyst such as toluene sulfonic acid, sulfuric acid, aluminum chloride, boron trifluoride-diethyletherate, methane sulfonic acid, hydrochloric acid, ammonium sulfate, phosphoric acid, sodium methoxide or the like. These conditions and variations thereof are well known in the art.

When the ester is a non-nitrogen-containing ester, it is preferable that substantially all the carboxy functions of the interpolymers be reacted with the alcohols and alkoxylates. Nevertheless, useful products can be obtained when at least about 50%, preferably at least about 70%, more preferably at least about 90% and advantageously at least about 95% of the carboxy functions have been so reacted. An excess of alcohols and alkoxylates over the stoichiometric requirement for complete esterification of the carboxy functions is often used. As a practical matter, however, complete esterification may be too difficult or time consuming to achieve. While excess (over stoichiometric requirement) of alcohols and alkoxylates or unreacted alcohols and alkoxylates need not be removed as such alcohols and alkoxylates can serve, for example, as diluent or solvent in the use of the esters, and similarly, optional reaction media, e.g., toluene, need not be removed as they can similarly serve as diluent or solvent in the use of the esters, it is generally preferred that unreacted alcohols, alkoxylates and diluents are removed by techniques, such as distillation, etc., that are well-known in the art.

As noted above, the compositions of this invention contain ester groups. The esterified interpolymers each contain ester groups having at least 8 carbon atoms. The ester groups are formed by reacting the carboxy-containing interpolymer with alcohols. The alcohol generally contains at least 7 carbon atoms. In one embodiment, the alcohol contains from about 7, or about 8 to about 18, carbon atoms. Examples of useful alcohols include heptanol, octanol, decanol, dodecanol, tridecanol, pentadecanol, octadecanol, etc.

One class of alcohols includes commercially available mixtures of alcohols. These include oxoalcohols which comprise, for example, a mixture of alcohols having from about 8–24 carbon atoms. Of the various commercial alcohols useful in this invention, one contains from about 8 to about 10 carbon atoms, and another from about 12 to about 18 aliphatic carbon atoms. The alcohols may comprise, for example, octyl alcohol, decyl alcohol, dodecyl alcohol, tetradecyl alcohol, pentadecyl alcohol, octadecyl alcohol, etc. Several suitable sources of these alcohol mixtures are the technical grade alcohols sold under the name Neodol® alcohols (Shell Oil Company, Houston, Tex.) and under the name Alfol® alcohols (Vista Chemical, Westlake, La.), and fatty alcohols derived from animal and vegetable fats and sold commercially by, for example, Henkel, Condea, and Emory.

Tertiary alkanolamines, i.e., N,N-di-lower alkyl aminoalkanolamines, may be used to prepare the esterified interpolymers. Examples include N,N-dimethylethanolamine, N,N-diethylethanolamine, and 5-diethylamino-2-pentanol.

The esterified interpolymers may be mixed esters derived from a combination of alcohols including alcohols containing at least 7 carbon atoms (relatively high molecular weight alcohols) and alcohols containing less than 7 carbon atoms (relatively low molecular weight alcohols). Alcohols containing at least 7 carbon atoms are those described hereinabove. Alcohols containing less than 7 carbon atoms generally contain from 1, or about 2, to about 6, or to about 5 carbon atoms. Examples of the low molecular weight alcohols include methanol, ethanol, propanol, butanol, pentanol, hexanol, cyclopentanol, and cyclohexanol. The above list is also meant to include the various isomeric arrangements of these alcohols. For instance, butanol refers to n-butanol, sec-butanol, isobutanol, etc.

Mixed esters of the carboxy-containing interpolymer are most conveniently prepared by first esterifying the carboxy-containing interpolymer with a relatively high molecular weight alcohol and a relatively low molecular weight alcohol to convert at least about 50%, or about 70% up to about 95%, or to about 98% up to about 100% of the carboxy groups of the interpolymer to ester groups. Nitrogen-containing esters are prepared by neutralizing any remaining carboxy groups with ammonia, an amine, or a hydrazine such as those described below to obtain nitrogen-containing esters.

To incorporate the appropriate amounts of the two alcohol groups into the polymer to form mixed esters, the ratio of the high molecular weight alcohol to the low molecular weight alcohol used in the process should be within the range of from about 2:1 to about 9:1 on a molar basis. In most instances, the ratio is from about 2.5:1 to about 5:1.

When utilizing a combination of a high molecular weight alcohol and a low molecular weight alcohol, the esterification may be carried out, for example, by initially esterifying at least about 50 molar percent or from about 50 to 75 molar percent, frequently up to about 90 molar percent of the carboxy radicals with the high molecular weight alcohol and then subsequently esterifying the partially-esterified carboxy-containing interpolymer with a low molecular weight alcohol, e.g., 2–4 carbon atoms, to obtain a carboxy interpolymer having approximately 50–90 molar percent of the carboxylic groups esterified with the high molecular weight aliphatic alcohol and approximately 8–48 molar percent of the carboxy radicals esterified with the low molecular weight aliphatic alcohol. For example, esterification with a combination of high and low molecular weight alcohols may be accomplished, in sequence, by first carrying out the esterification with the high molecular weight alcohol, e.g., up to about 75 molar percent and subsequently esterifying the remaining carboxylic groups with the low molecular weight alcohol, to attain the desired degree of esterification.

Alternatively, the carboxylic groups of the interpolymer may be simultaneously esterified with a mixture of the alcohols to obtain an esterified carboxy-containing interpolymer having up to about 60, or to about 70, or to about 80, or to about 90, or to about 95 or to about 98 mole percent, up to 100%, of the carboxylic groups esterified with combination of high and low molecular weight aliphatic alcohols.

In another embodiment, the carboxy-containing interpolymers contains a carbonyl-amino group. The carbonyl-amino groups include amides, imides, amidines, ammonium salts, amidic acid salts or mixtures thereof. A carbonyl-amino group is derived from the carboxy group of the carboxy-containing interpolymer and an amine. The carbonyl-amino group may be present when the carboxy-containing interpolymer contains esters derived from a single alcohol or mixtures of alcohol as described above.

Unesterified carboxylic groups of the interpolymer may be converted to carbonyl-amino groups by reaction with ammonia or an amine. The amines which are used to form carbonyl-amino group may be mono- or polyamines provided that the average number of primary and secondary amino nitrogens ranges from about 1 to about 1.1. To illustrate, the amine may be a monoamine containing one primary or secondary amino group. Here the number of primary or secondary amino groups is 1. The amine may be a polyamine, wherein one amino group is primary or secondary and one or more are tertiary. Aminopropylmorpholine and dimethylaminopropyl amine are examples. The amine reactant may also be a mixture of these with one or more polyamines containing 2 or more primary or secondary amino groups, provided that the average number of primary or secondary amino groups in the mixture is no greater than about 1.1, preferably less than 1.05.

Examples of monoamines include aliphatic amines such as mono-, di- and tri-alkyl amines having alkyl groups containing from 1 to about 20 carbon atoms as well as cyclic monoamines. In one embodiment, the amines are polyamines having from 1 to about 1.1, preferably one, primary or secondary amino group, and at least one monofunctional amino group such as a tertiary-amino group or heterocyclic amino group derived from pyrroles, pyrrolidones, caprolactams, oxazolidones, oxazoles, thiazoles, pyrazoles, pyrazolines, imidazoles, imidazolines, thiazines, oxazines, diazines, oxacarbamyl, thiocarbamyl, uracils, hydantoins, thiohydantoins, guanidines, ureas, sulfonamides, phosphoramides, phenolthiazines, amidines, etc. In one embodiment, the carbonyl-polyamino group is derived from a morpholine. Examples of morpholines include aminoethylmorpholine, aminopropylmorpholine, etc. Examples of such polyamines include dimethylamino-ethylamine, dibutylamino-ethylamine, 3-dimethylamino-1-propylamine, 4-methylethylamino-1-butylamine, pyridyl-ethylamine, N-morpholinoethylamine, tetrahydropyridyl-ethylamine, bis-(dimethylamino)propylamine, bis (diethylamino)ethylamine, N,N-dimethyl-p-phenylene diamine, piperidyl-ethylamine, 1-aminoethylpyrazone, 1-(methylamino)pyrazoline, 1-methyl-4-aminooctyl pyrazole, 1-aminobutylimidazole, 4-aminoethylthiazole, 2-aminoethyltriazine, dimethylcarbamylpropylamine, N-methyl-N-aminopropylacetamide, N-aminoethylsuccinimide, N-methylaminomaleimide, N-aminobutylalpha-chlorosuccinimide, 3-aminoethyluracil, 2-aminoethylpyridine, ortho-aminoethyl-N,N-dimethylbenzenesulfamide, N-aminoethylphenothiazine, N-aminoethylacetamidine, 1-aminophenyl-2-methyl-imidazoline, N-methyl-N-aminoethyl-S-ethyldithiocarbamate, etc. For the most part, the amines are those which contain only one primary-amino or secondary-amino group and, preferably at least one tertiary-amino group. The tertiary amino group is preferably a heterocyclic amino group. In some instances polyamines may contain up to about 6 amino groups although, in most instances, they contain one primary-amino group and either one or two tertiary-amino groups. The polyamines may be aromatic or aliphatic amines and are preferably heterocyclic amines such as aminoalkyl-substituted morpholines, piperazines, pyridines, benzopyrroles, quinolines, pyrroles, etc. They are usually amines having from 4 to about 30, or to about 12 carbon atoms. Polar substituents may likewise be present in the amines.

The carbonyl-amino groups of the carboxy-containing interpolymers also may comprise the groups derived from hydrazine and/or a hydrocarbon-substituted hydrazine including, for example, the mono, di-, tri-, and tetrahydrocarbon-substituted hydrazines wherein the hydrocarbon substituent is either an aliphatic or aromatic substituent including, for example, the alkyl-, e.g., cyclic and/or acyclic groups, aryl-, alkylaryl-, aralkyl, etc. The hydrocarbon substituents, generally, contain from 1, up to about 24 or up to about 12 aliphatic carbon atoms. The preferred substituents, however, include for example, phenyl, alkylphenyl or an alkyl group wherein the alkyl group is either a methyl, ethyl, propyl, butyl, pentyl, octyl, cyclohexyl, decyl or dodecyl group. Other examples of the hydrocarbon groups include octadecyl, behenyl, benzyl, heptaphenyl, alpha-naphthyl, beta-naphthyl, butyl-naphthyl, oleyl, and stearyl groups. Of the various hydrocarbon-substituted hydrazines, a preferred class includes the N,N-dihydrocarbon-substituted hydrazines, e.g., the dimethyl, diethyl, diphenyl and dibutyl hydrazines.

In the embodiment where the carboxy-containing interpolymer is characterized as containing a carbonyl-amino group, the carboxy-containing interpolymer may be esterified as described above. Following esterification of the carboxy groups of the interpolymer with either one or more of the high and low molecular weight alcohols, at least about 2 molar percent, or from about 2, or about 5, up to 50, or to about 5 molar percent of the carboxy groups of the interpolymer may be reacted with an amine at temperatures ranging from about 80°–300° C., up to 350° C. or higher provided that said temperature is maintained below the decomposition point of either the reactants and the products obtained thereof. Thus, for example, at least about 50 mole percent, e.g., 50–98 mole percent, of the carboxy groups of a carboxy-containing interpolymer may be esterified with a high molecular weight aliphatic alcohol and then subsequently reacted with a amine, to obtain a nitrogen-containing ester having about 2 to about 50 or to about 35 molar percent of the carboxylic groups converted to carbonyl-amino groups. If a mixture of alcohols including the high molecular weight and low molecular weight alcohols is used to esterify the carboxyl groups of said interpolymer, then at least about 2 molar percent of the carboxyl groups of said interpolymer are reacted with the amine, to obtain the carbonyl-amino groups. The amount of amine is sufficient to neutralize substantially all of the unesterified carboxy groups of the polymer. An excess of amine may be used.

In another embodiment, the carboxy-containing interpolymer is reacted with a relatively high molecular weight alcohol, a relatively low molecular weight alcohol and an amine. The alcohols and amines have been described above. The alcohols may be reacted with the interpolymer to form an intermediate which is subsequently reacted with the amine. Alternatively the alcohols and amine may be reacted with the interpolymer simultaneously. The relative proportions of the ester groups to the carbonyl-amino group are expressed in terms of molar ratios of (20–70):(80–30):(0–20):(0.1–10) respectively. The preferred ratio is (40–60):(70–45):(0–10):1–6).

Examples of Esterification of the Interpolymer

The following examples serve to illustrate the preparation of the esters and nitrogen-containing esters of the carboxy-containing interpolymers used in this invention and are not intended as limiting thereof. Unless otherwise indicated in these and the following examples, or in the specification, all parts and percentages are by weight, and temperatures are in degrees Celsius. Sulfuric acid is typically commercially available 93–96% $H_2SO_4$. Methanesulfonic acid is nominally 70% in $H_2O$. The extent of esterification is calculated by determining the total acid number (phenolphthalein indicator) and the strong acid number (bromphenol blue indicator) of the reaction mixture. The total acid number includes contributions from unesterified polymer and catalyst. The strong acid number is the measure of the acid number of the catalyst. The difference between the two acid numbers, the net acid number, is the acid number due to unesterified polymer.

EXAMPLE 1-E

The product of Example 2 (101 parts), Neodol 91 (56 parts), a product of Shell Chemical Company identified as a mixture of $C_9$, $C_{10}$ and $C_{11}$ alcohols, TA-1618 (92 parts), a product of Proctor & Gamble identified as a mixture of $C_{16}$ and $C_{18}$ alcohols, Neodol 25 (62 parts), a product of Shell Chemical Company identified as a mixture of $C_{12}$, $C_{13}$, $C_{14}$, and $C_{15}$ alcohols, and toluene and the contents are heated. Methane sulfonic acid (5 parts ) is added to the mixture. The mixture is heated under reflux conditions for 30 hours. The materials are vacuum stripped. The residue is mixed with 50 parts diphenyl alkane (Wibarco).

EXAMPLE 2-E

The product of Example 2 (202 parts), Neodol 91 (112 parts), TA 1618 (184 parts), Neodol 25 (124 parts) and toluene (875 parts) are charged to a vessel. The mixture is then heated and stirred. Methanesulfonic acid (10 parts) is added to the mixture which is then heated under reflux conditions for 31 hours. The materials are vacuum stripped, then mixed with 75 parts hydrotreated naphthenic oil.

EXAMPLE 3-E

The product of Example 2 (101 parts), Alfol 810 (50 parts), a product of Vista Chemical identified as a mixture of $C_8$ and $C_{10}$ alcohols, IA-1618 (92 parts), Neodol 25 (62 parts) and toluene (437 parts) are charged to a vessel. The mixture is heated and stirred. Methanesulfonic acid (5 parts) is added to the mixture which is heated under reflux conditions for 30 hours. Hydrotreated naphthenic oil (50 parts) are added and the materials are vacuum stripped.

EXAMPLE 4-E

A reactor is charged with 389 parts of the toluene slurry of Example 2 and 103 parts of Alfol 1218, the materials are heated to 95° C. under $N_2$ whereupon a solution of 5.5 parts methanesulfonic acid in 68 parts Alfol 8–10 is charged. The material are heated to 150° C. while removing water of esterification and excess toluene, the reaction is continued for 5 hours followed by addition over 0.25 hour of 3.7 parts butanol. The materials are refluxed until the net acid number indicates at least 95% esterification. The materials are stripped and filtered. The filtrate is mixed with 100 parts hydrotreated naphthenic oil

EXAMPLE 5-E

Charge a vessel with a slurry (870 parts) having 15.5% solids and 84.5% volatiles of the interpolymer of Example 1 and 278 parts Alfol 1218. Heat the mixture to 100° C. under nitrogen with medium agitation. Add 3.1 parts sulfuric acid and 48.7 parts of Alfol 810. Raise the temperature of the mixture to 145° C.–150° C. by removing toluene-water distillate. Add 301 parts of a hydrotreated naphthenic oil. Maintain the temperature of the mixture at 145° C.–150° C. for 6 hours. Add 54 parts hydrotreated naphthenic oil. Maintain at 145° C.–150° C. until net acid number indicates that esterification is at least 75% complete. Add 26.7 parts of n-butanol dropwise over 15 minutes. Maintain the temperature of the mixture at 145° C.–150° C. for 3 hours. Add solution of 0.52 parts sulfuric acid and 26.7 parts of butanol dropwise over 10 minutes. Maintain the temperature of the mixture at 145° C.–150° C. until the net acid number indicates that the esterification is at least 95% complete. Add sodium hydroxide (0.96 parts of a 50% aqueous solution) to the mixture, then 1.36 parts Ethyl Antioxidant 733. Vacuum strip the mixture at 155° C. and 5 mm Hg. Add 10 parts diatomaceous earth to the mixture along with 1.36 parts Ethyl Antioxidant 733. Cool to 100° C. and filter through a heated funnel.

EXAMPLE 6-E

The procedure of Example 5-E is followed except that 3.5 parts of toluene sulfonic acid is used in place of sulfuric acid as the esterification catalyst.

EXAMPLE 7-E

The procedure of Example 5-E is followed except that 2.5 parts of phosphoric acid is used in place of sulfuric acid as the esterification catalyst.

EXAMPLE 8-E

Esterify a toluene slurry (928 parts) having 15.5% solids and 84.5% volatiles of the interpolymer of Example utilizing the same procedure as Example 5-E. Use 348 parts Alfol 1218, 16 parts Alfol 810, 4.53 parts of sulfuric acid , 293 parts of hydrotreated naphthenic oil, 66.6 parts of butanol, 1.46 parts of Ethyl Antioxidant 733 and 10 parts of diatomaceous earth.

EXAMPLE 9-E

Charge to a suitable vessel 404 parts of the interpolymer slurry of Example 4 and 555 parts Alfol 1218. Heat the mixture to 100° C. with agitation under nitrogen. Add Alfol 810 (98 parts) and methanesulfonic acid (6.4 parts) to the mixture. Raise the temperature to 150° C. by removal of water-xylene distillate. Maintain the temperature of the mixture at 150° C. until net acid number indicates that esterification is at least 75% complete. Add butanol (104 parts) dropwise to the mixture. Maintain the temperature of the mixture at 150° C. until the net acid number indicates that esterification is at least 95% complete. Add Ethyl Antioxidant 733 (4.6 parts) and 2 parts 50% aqueous sodium hydroxide to the mixture, mix, then vacuum strip at 150° C. and 20 mm Hg. Cool to 100° C., add 4.6 parts Ethyl Antioxidant 733 and 36 parts diatomaceous earth then filter through a heated funnel. Mix the filtrate with 150 parts of hydrotreated naphthenic oil.

EXAMPLE 10-E

Charge to a suitable vessel a toluene slurry (1688 parts) having 12.32% solids and 87.68% volatiles of the interpolymer of Example 5, 257 parts Alfol 1218 and 130 parts hydrotreated naphthenic oil. Heat the mixture to 100° C. with medium agitation under nitrogen. Add 4.22 parts sulfuric acid and 45 parts Alfol 810 to the mixture. Heat the mixture to 150° C. by removing toluene-water distillate. Add 27 parts butanol to the mixture. Maintain the temperature of the mixture at 150° C. for 1-½ hours. Add a second portion of 27 parts butanol to the mixture. Maintain the temperature of the mixture at 150° C. until the net acid number indicates that esterification is at least 95% complete. Add sodium hydroxide (1.44 parts of a 50% aqueous solution) and 1.04 parts Isonox 133 (Schenectady Chemicals, Freeport. Tex.) to the mixture. Vacuum strip the mixture at 150° C. and 100 torr. Add a second portion of Isonox 133 (1.04 parts) along with diatomaceous earth (16 parts). Cool the mixture to 100° C. and filter through a hot funnel.

EXAMPLE 11-E

Esterify 208 parts of the interpolymer of Example 6 by the same procedure as Example 8-E. Use 257 parts of Alfol 1218, 45 parts of Alfol 810, 130 parts of hydrotreated naphthenic oil, 4.22 parts of sulfuric acid, 54 parts of butanol, 1.28 parts of a 50% aqueous solution of sodium hydroxide, 2 parts of Isonox 133 and 16 parts of diatomaceous earth.

EXAMPLE 12-E

Esterify 208 parts of the interpolymer of Example 7 by the same procedure as Example 8-E. Use 257 parts of Alfol 1218, 45.2 parts of Alfol 810, 222 parts of hydrotreated naphthenic oil, 4.22 parts of sulfuric acid, 54 parts of butanol, 2 parts of a 50% aqueous sodium hydroxide solution, 2.22 parts of Isonox 133 and 15 parts of diatomaceous earth.

EXAMPLE 13-E

Esterify the interpolymer of Example 8 by the same procedure as 8-E. Use 278 parts of Alfol 1218, 49 parts of Alfol 810, 136 parts of hydrotreated naphthenic oil, 4.21 parts of sulfuric acid, 54 parts butanol, 1.14 parts of a 50% aqueous sodium hydroxide solution, 2.08 parts of Isonox 133 and 16 parts of diatomaceous earth.

EXAMPLE 14-E

Esterify the interpolymer of Example 9 by the same procedure as 8-E. Use 257 parts of Alfol 1218, 45 parts of Alfol 810, 310 parts of hydrotreated naphthenic oil, 4.2 parts of sulfuric acid, 54 parts butanol, 1.21 parts of a 50% aqueous sodium hydroxide solution, 2 parts of Isonox 133 and 16 parts of diatomaceous earth.

EXAMPLE 15-E

Esterify the interpolymer of Example 10 by the procedure utilized in Example 8-E. Use 278 parts of Alfol 1218, 49 parts of Alfol 810, 362 parts of hydrotreated naphthenic oil, 4.21 parts of sulfuric acid, 54 parts butanol, 1.28 parts of a 50% aqueous sodium hydroxide solution, 1.72 parts of Isonox 133 and 20 parts of diatomaceous earth.

EXAMPLE 16-E

Esterify the interpolymer of Example 11 utilizing the procedure described in Example 8-E. Use 257 parts of Alfol 1218, 45.2 parts of Alfol 810, 134 parts of hydrotreated naphthenic oil, 54 parts butanol, 2.05 parts of a 50% aqueous sodium hydroxide solution, 2.08 parts of Isonox 133 and 16 parts of diatomaceous earth. Replace the sulfuric acid of Example 8-E with 5.46 parts of methanesulfonic acid.

EXAMPLE 17-E

A reactor is charged with 815 parts of the terpolymer slurry of Example 12 and 65 parts Cross Oil Co. L-40. The mixture is stripped to remove toluene followed by addition of 104.4 parts Alfol 1218, the batch is heated to 96° C. then 5.3 parts of methanesulfonic acid and 49 parts Alfol 8–10 are charged followed by heating to 146° C. The batch is held at 146°–152° C. until the acid no is between 19–21 whereupon 10.7 parts butanol are added. The reaction is continued until the acid number is 5–6, then 1.1 parts 50% aqueous NaOH are added followed by mixing for 1 hour at 150° C. The material are vacuum stripped then filtered.

EXAMPLE 18-E

Esterify 212 parts of the interpolymer of Example 13 according to the procedure as described in Example 8-E, except use 5.46 parts of methanesulfonic acid in place of sulfuric acid. Use 278 parts of hydrotreated naphthenic oil, 54 parts of butanol, 2 parts of a 50% aqueous sodium hydroxide solution, 2.08 parts of Isonox 133 and 16 parts of diatomaceous earth.

EXAMPLE 19-E

Charge to a suitable vessel a toluene slurry (1688 parts) having 12.32% solids and 87.68% volatiles of the interpolymer of Example 2, Alfol 1218 (217 parts) and hydrotreated naphthenic oil (130 parts). Heat the mixture to 100° C. with medium agitation under nitrogen. Add 4.22 parts sulfuric acid and 101 parts Alfol 810 to the mixture. Heat the mixture to 150° C. by removing toluene-water distillate. Add 20 parts butanol to the mixture. Maintain the temperature of the mixture at 150° C. for 1-½ hours. Add a second portion of 20 parts butanol to the mixture. Maintain the temperature of the mixture at 150° C. until the net acid number indicates that esterification is at least 95% complete. Vacuum strip the mixture at 150° C. and 100 mm Hg. Cool the mixture to 100° C. and filter through a hot funnel.

EXAMPLE 20-E

Charge to a suitable vessel 404 parts of the interpolymer of Example 4 and 555 parts Alfol 1218. Heat the mixture to 100° C. with agitation under nitrogen. Add 98 parts Alfol 810 and 6.4 parts methanesulfonic acid to the mixture. Raise the temperature to 150° C. by removal of water-xylene distillate. Maintain the temperature of the mixture at 150° C. until net acid number indicates that esterification is at least 75% complete. Add 104 parts butanol dropwise. Maintain the temperature at 150° C. until net acid number indicates that esterification is at least 95% complete. Vacuum strip the mixture at 150° C. and 20 mm Hg. Cool the mixture to 100° C. and add 36 parts diatomaceous earth. Filter the mixture through a heated funnel. Mix the filtrate with 200 parts hydrotreated naphthenic oil.

EXAMPLE 21-E

The product prepared according to the procedure of Example 14 (2022 parts) is mixed with an additional 80 parts of alkylated aromatic hydrocarbon, then 744 parts additional aromatic hydrocarbon are added followed by 1600 parts oleyl alcohol, 49.7 parts methanesulfonic acid and an additional 142 parts aromatic hydrocarbon. The batch is heated to 157° C. and is maintained at 157°–160° C. while $N_2$ blowing until the acid number is below 6. The product is cooled, then collected.

Examples of Incorporation of Carbonyl-Amino Group

The following examples serve to illustrate the preparation of nitrogen-containing esters of the carboxy-containing interpolymers used in this invention and are not intended as limiting thereof. Unless indicated otherwise, all parts and percentages are by weight and temperatures are in degrees Celsius.

EXAMPLE 1-N

Aminopropyl morpholine (12.91 parts) is added to the mixture of Example 1-E, before stripping. The mixture is heated under reflux conditions for an additional 4 hours. Diatomaceous earth (30 parts) and hydrotreated naphthenic oil (302 parts) are added to the mixture which is then stripped. The residue is filtered.

EXAMPLE 2-N

The procedure of Example 1-N is followed except that N-aminoethyl- and 1-methyl-4-aminoethyl piperazine (0.1 mole consumed per carboxy equivalent of the interpolymer) is used in place of aminopropyl morpholine.

EXAMPLE 3-N

The procedure of Example 1-N is followed except that dimethylaminoethylamine is substituted for the aminopropyl morpholine used on a molar basis.

EXAMPLE 4-N

The procedure of Example 1-N is followed except that dibutylaminopropylamine is substituted for the aminopropyl morpholine on a molar basis.

EXAMPLE 5-N

The procedure of Example 1-N is followed except that the aminopropyl morpholine used is replaced on a chemical equivalent basis with N-aminoethyl pyrrole.

EXAMPLE 6-N

The procedure of Example 1-N is followed except that the aminopropyl morpholine used is replaced on a chemical equivalent basis with N-aminophenyl oxazolidone.

EXAMPLE 7-N

The procedure of Example 1-N is followed except that the aminopropyl morpholine used is replaced on a chemical equivalent basis with 1-aminoethyl-2-heptadecylimidazoline.

EXAMPLE 8-N

The procedure of Example 1-N is followed except that the aminopropyl morpholine used is replaced on a chemical equivalent basis with 4-aminobutyl pyridine.

EXAMPLE 9-N

Aminopropyl morpholine (27.91 parts) is added to the mixture of Example 2-E, before stripping, which is then heated under reflux conditions for an additional 5 hours. Diatomaceous earth (60 parts) is added to the mixture which is then stripped, 600 parts of polymer remaining in the vessel. A hydrotreated naphthenic oil (600 parts) is added to the mixture which is then homogenized. The mixture is filtered through a heated funnel.

EXAMPLE 10-N

To an ester prepared as in Example 4-E, before stripping and filtration, is added at 150° C., 6.3 parts aminopropyl morpholine. The materials are heated at 150° C. for 0.5 hour, 2.3 parts alkylated diphenyl amine and 68 parts Cross L-40 oil are added followed by stripping to 150° C. at 40–50 mm Hg. The residue is filtered.

EXAMPLE 11-N

Aminopropyl morpholine (15.6 parts) is added to the mixture of Example 3-E, before stripping, which is then heated under reflux conditions for an additional 5 hours. The mixture is stripped to yield 304 parts of a yellow-orange viscous liquid. Diatomaceous earth (30 parts) and hydrotreated naphthenic oil (304 parts) are added to the mixture which is then homogenized. The mixture is filtered through a heated funnel to yield 511 parts of a clear amber viscous liquid.

EXAMPLE 12-N

To an ester prepared as in Example 17-E, but before the final stripping are added 5.8 parts aminopropyl morpholine, followed by heating for 1 hour at 150° C. then addition of 1 part alkylated diphenyl amine. The batch is vacuum stripped and filtered.

EXAMPLE 13-N

Add 15 parts aminopropylmorpholine and di-tert-butyl phenol (1.04 parts) to the mixture of Example 19-E, before stripping and filtration. Vacuum strip the mixture at 150° C. and 100 mm Hg. Add a second portion of di-tert-butyl phenol (1.04 parts) along with diatomaceous earth (16 parts). Cool the mixture to 100° C. and filter through a hot funnel. Mix the filtrate with 100 parts hydrotreated naphthenic oil.

EXAMPLE 14-N

Add Ethyl Antioxidant 733 (4.6 parts) and 30 parts aminopropylmorpholine to the product of Example 20-E before stripping and filtration. Vacuum strip the mixture at 150° C. and 20 mm Hg. Cool the mixture to 100° C., add 100 parts hydrotreated naphthenic oil, 4.6 parts Ethyl Antioxidant 733, and 36 parts diatomaceous earth, then filter the mixture through a heated funnel.

EXAMPLE 15-N

A product prepared as in Example 20-E, before stripping and filtration, is reacted with 7.7 parts of aminopropyl morpholine, mixed for 0.25 hour, then stripped at 150°–160° C. at 25 mm Hg. Alkylated diphenyl amine(1 part) and 88 parts Cross L-40 oil are added and the material is filtered.

EXAMPLE 16-N

A product prepared as in Example 1-E before stripping and filtration, is reacted with 6.3 parts of aminopropyl morpholine, mixed for 0.25 hour, stripped at 150°–160° C. at 25 mm Hg, 2.3 parts alkylated diphenyl amine and 88 parts Cross L-40 oil are added and the material is filtered.

The mixtures of diluent and esterified interpolymers of this invention are useful as viscosity-improving additives for lubricating oil compositions. As noted above, they provide exceptional low temperature properties without an adverse impact on higher temperature viscosity. Nitrogen-containing materials also provide enhanced dispersancy.

Lubricating oil compositions of this invention comprise a major amount of an oil of lubricating viscosity and a minor amount of the additive concentrates of this invention. By a major amount is meant more than 50% by weight. Thus, for example, 51%, 80% and 99% are major amounts. A minor amount is less than 50% by weight. Examples of minor amounts are 1%, 20% and 49%.

The additive concentrates of this invention are used in effective amounts to provide the desired viscosity index and dispersancy. Typically, on a neat chemical basis, the are employed to provide from about 0.01 to about 10% by weight, more often from about 0.20% to about 5% by weight of esterified interpolymer.

The Oil of Lubricating Viscosity

The lubricating compositions and methods of this invention employ an oil of lubricating viscosity, including natural and synthetic oils and mixtures thereof.

Natural oils include animal oils and vegetable oils (e.g. castor oil, lard oil) as well as mineral lubricating oils such as liquid petroleum oils and solvent-treated, acid treated, and/or hydrotreated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins, etc. and mixtures thereof, alkylbenzenes, polyphenyl, (e.g., biphenyls, terphenyls, alkylated polyphenyls, etc.), alkylated diphenyl ethers and alkylated diphenyl sulfides and the derivatives, analogs and homologues thereof and the like.

Alkylene oxide polymers and interpolymers and derivatives thereof where their terminal hydroxyl groups have been modified by esterification, etherification, etc., constitute another useful class of known synthetic lubricating oils.

Another suitable class of synthetic lubricating oils that can be used comprises the esters of di- and polycarboxylic acids and those made from $C_5$ to $C_{20}$ monocarboxylic acids and polyols and polyolethers.

Other synthetic lubricating oils include liquid esters of phosphorus-containing acids, polymeric tetrahydrofurans and the like, silicon-based oils such as the polyalkyl-polyaryl-, polyalkoxy-, or polyaryloxy-siloxane oils and silicate oils.

Unrefined, refined and rerefined oils, either natural or synthetic (as well as mixtures of two or more of any of these) of the type disclosed hereinabove can be used in the compositions of the present invention. Unrefined oils are those obtained directly from natural or synthetic sources without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin, III, U.S. Pat. No. 4,326,972 and European Patent Publication 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

Other Additives

As mentioned, lubricating oil compositions of this invention may contain other components. The use of such additives is optional and the presence thereof in the compositions of this invention will depend on the particular use and level of performance required. Thus the other additive may be included or excluded. The compositions may comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and antioxidancy performance.

In addition to zinc salts of dithiophosphoric acids discussed hereinabove, other additives that may optionally be used in the lubricating oils of this invention include, for example, detergents, dispersants, viscosity improvers, oxidation inhibiting agents, pour point depressing agents, extreme pressure agents, anti-wear agents, color stabilizers and anti-foam agents. The above-mentioned dispersants and viscosity improvers may be used in addition to the additives of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, molybdenum compounds, and the like.

Other oxidation inhibiting agents include materials such as alkylated diphenyl amines, hindered phenols, especially those having tertiary alkyl groups such as tertiary butyl groups in the position ortho to the phenolic —OH group, and others. Such materials are well known to those of skill in the art.

Auxiliary viscosity improvers (also sometimes referred to as viscosity index improvers or viscosity modifiers) may be included in the compositions of this invention. Viscosity improvers are usually polymers, including polyisobutenes, polymethacrylic acid esters, hydrogenated diene polymers, polyalkyl styrenes, esterified styrene-maleic anhydride copolymers, hydrogenated alkenylarene-conjugated diene copolymers and polyolefins. Multifunctional viscosity improvers, other than those of the present invention, which also have dispersant and/or antioxidancy properties are known and may optionally be used in addition to the products of this invention. Such products are described in numerous publications including those mentioned in the Background of the Invention. Each of these publications is hereby expressly incorporated by reference.

Pour point depressants other than those of this invention may be included in the lubricating oils described herein. Those which may be used are described in the literature and are well-known to those skilled in the art.; see for example, page 8 of "Lubricant Additives" by C. V. Smalheer and R. Kennedy Smith (Lezius-Hiles Company Publisher, Cleveland, Ohio, 1967). Pour point depressants useful for the purpose of this invention, techniques for their preparation and their use are described in U. S. Pat. No. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by a least one direct carbon-to-phosphorus linkage.

The term "basic salt" is used to designate metal salts wherein the metal is present in stoichiometrically larger amounts than the organic acid radical. The relative amount of metal present in "basic salts" is frequently indicated by the expression "metal ratio" (abbreviated M.R.), which is defined as the number of equivalents of metal present compared to a "normal", stoichiometric amount. Thus, for example, a basic salt containing twice the amount of metal compared to the stoichiometric amount, has a metal ratio (M.R.) of 2. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols and/or basic inorganic materials. Examples of these "carboxylic dispersants" are described in British Patent number 1,306,529 and in many U.S. patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Polymers and copolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated additives may each be present in lubricating compositions at a concentration of as little as 0.001% by weight, usually ranging from about 0.01% to about 20% by weight. In most instances, they each contribute from about 0.1% to about 10% by weight, more often up to about 5% by weight.

These additives can be added directly to lubricating oil. Preferably, however, they are diluted with a substantially inert, normally liquid organic diluent such as mineral oil, naphtha, benzene, toluene or xylene, to form an additive concentrate. The additive concentrates of this invention may be incorporated into these additive concentrates to form a new concentrate. Alternatively, these additional; additives may be incorporated into the additive concentrates of this invention. Preferred additive concentrates contain the diluents referred to hereinabove, provided that additive concentrates of this invention include the specified amounts of naphthenic or synthetic oils. These concentrates usually comprise from about 0.01 to about 90% by weight, often about 0.1 to about 80% by weight of the compositions of this invention and may contain, in addition, one or more other additives known in the art or described hereinabove. Concentrations such as 15%, 20%, 30% or 50% or higher may be employed.

The lubricating compositions of this invention are illustrated by the examples in the following Table. The lubricating compositions are prepared by combining the specified ingredients, individually or from concentrates, in the indicated amounts and oil of lubricating viscosity to make the total 100 parts by weight. The amounts shown are parts by weight and, unless indicated otherwise, are amounts of chemical present on an oil-free basis. Thus, for example, an additive comprising 50% oil used at 10% by weight in a blend, provides 5% by weight of chemical. Amounts of components referred to by example number are as prepared These examples are presented for illustrative purposes only, and are not intended to limit the scope of this invention.

In the Examples of Table I, the nitrogen-containing esterified interpolymer of Example 12N is combined in the indicated amounts with a mineral oil of lubricating viscosity, 1.43% of a polybutene ($M_n \cong 1000$) substituted succinic anhydride-ethylene polyamine reaction product, 0.29% of $CS_2$ post treated polybutene ($M_n \cong 1000$) substituted succinic anhydride-ethylene polyamine reaction product, 0.15% of dibutyl hydrogen phosphite, 0.04% of 85% phosphoric acid, 0.33% borated polybutene ($M_n \cong 1000$) substituted succinic anhydride-ethylene polyamine reaction product, 0.20% borated $C_{16}$ epoxide, 0.2% N-phenyl alpha-naphthylamine, 0.50% of reaction product of t-dodecyl mercaptan and propylene oxide, 0.02% of N,N-diethanol tallow amine, 0.08% of zinc oleate, 0.025% red dye, and 0.42% of di-(nonylphenyl) amine.

TABLE 1

| Example | Weight % |
|---|---|
| I | 9.3 |
| II | 10.0 |

TABLE 1-continued

| Example | Weight % |
|---|---|
| III | 10.5 |
| IV | 11.0 |

EXAMPLE V

A mineral oil of lubricating viscosity is combined with 17% of the nitrogen-containing esterified interpolymer of Example 12N and 6.5% of an additive concentrate containing 41.19% sulfurized isobutylene, 15.53% of phosphoric acids from hydroxypropyl ester of methyl amyl dithiophosphoric acid reacted with $P_2O_5$ and neutralized with a tertiary alkyl primary amine, 11.76% of a 60% in mineral oil solution of a polybutene ($M_n \cong 1000$) substituted succinic anhydride-ethylene polyamine reaction product, 10.12% of a 51% in mineral oil solution of a mixture of esters and succinimides derived from polybutene ($M_n \cong 1000$) substituted succinic anhydride which is then reacted with dimercaptothiadiazole, 3.19% triphenyl phosphite, 2.94% glycerol monooleate, 0.02% of a kerosene solution of silicone antifoams, 0.94% of a 40% in mineral oil solution of acrylate antifoams, 13.74% of a 61% solution in mineral oil of a borated magnesium overbased phenate and mineral oil diluent to make the total 100%.

EXAMPLE VI

A mineral oil of lubricating viscosity is combined with 17% of the nitrogen-containing esterified interpolymer of Example 12N and 7.0% of an additive concentrate containing 39.29% of a calcium overbased alkyl benzene sulfonate having metal ratio of 11, 25.14% of an 88% in mineral oil solution of a zinc salt of mixed primary-secondary alkyl dithiophosphoric acid, 7.14% of a sulfurized mixture of fatty acid, ester and olefin, 0.86% of a 40% in mineral oil solution of acrylate antifoams, 14.29% of a 69% in mineral oil solution of borated sodium overbased polybutene ($M_n \cong 1000$) substituted succinic anhydride, 7.14% glycerol monooleate, 0.02% of a kerosene solution of silicone antifoams, 0.94% of a 40% in mineral oil solution of acrylate antifoams, and mineral oil to bring the total to 100%.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. An additive concentrate comprising from about 5 to about 95% by weight of at least one organic diluent selected from the group consisting of naphthenic oils and synthetic oils, said diluent having Brookfield viscosity according to ASTM Procedure D-2983 ranging from about 50 to about 400 centipoise at −26° C. and from about 100 to about 1,500 centipoise at −40° C., and kinematic viscosity according to ASTM Procedure D-445 ranging from about 2.5 to about 6 centistokes at 40° C. and from about 1 to about 2.5 centistokes at 100° C., and from about 95 to about 5% by weight of an ester derived from a carboxy-containing interpolymer having a reduced specific viscosity (RSV) of from about 0.05 to about 0.35, said interpolymer being derived from at least two monomers, (i) one of said monomers being at least one of an aliphatic olefin containing from 2 to about 30 carbon atoms and a vinyl aromatic monomer and (ii) the other of said monomers being at least one alpha, beta-unsaturated acylating agent, said ester being characterized by the presence within its polymeric structure of each of the following groups which are derived from the carboxy groups of said interpolymer:

(A) from about 20 to about 70 mole %, based on moles of carboxyl groups in said interpolymer, of ester groups containing from about 12 to about 19 carbon atoms, (B) from about 80 to about 30 mole %, based on moles of carboxyl groups in said interpolymer, of ester groups containing from about 8 to about 11 carbon atoms, and optionally, (C) up to about 20 mole %, based on moles of carboxyl groups in said interpolymer, of ester groups containing from 2 to 7 carbon atoms.

2. The additive concentrate of claim 1 wherein the RSV of the interpolymer ranges from about 0.08 to about 0.25.

3. The additive concentrate of claim 1 comprising up to about 10 mole %, based on moles of carboxyl groups in said interpolymer, of ester groups containing from 2 to about 5 carbon atoms.

4. The additive concentrate of claim 3 comprising from about 0.05 to about 10 mole % based on moles of carboxyl groups in said interpolymer, of ester groups containing from 2 to about 5 carbon atoms.

5. The additive concentrate of claim 1 which is substantially free of ester groups containing from 5 to 7 carbon atoms.

6. The additive concentrate of claim 1 wherein the ester further comprises (D) a carbonyl-amino group derived from an amino compound having an average of from 1 to about 1.1 primary or secondary amino group, wherein the molar ratio of(A):(B):(C):(D) is (20–70):(80–30):(0–20):(0.1–10).

7. The additive concentrate of claim 1 wherein the aliphatic olefin is an alpha olefin.

8. The additive concentrate of claim 1 wherein the vinyl aromatic monomer is styrene or a substituted styrene.

9. The additive concentrate of claim 1 wherein the alpha, beta-unsaturated acylating agent is an aliphatic carboxylic acid or anhydride, or esters thereof.

10. The additive concentrate of claim 9 wherein the alpha, beta-unsaturated acid or anhydride, or ester thereof is at least one member selected from the group consisting of maleic acid or anhydride, itaconic acid or anhydride, fumaric acid, α-methylene glutaric acid, acrylic acid, methacrylic acid or an ester of any of these.

11. The additive concentrate of claim 1 wherein the interpolymer is derived from styrene and maleic anhydride.

12. The additive concentrate of claim 11 wherein the interpolymer is further derived from methacrylic acid or an ester thereof.

13. The additive concentrate of claim 1 wherein the mole ratio of (i):(ii) ranges from about 1:2 to about 3:1.

14. The additive concentrate of claim 12 wherein the mole ratio of styrene:maleic anhydride:methacrylic acid or ester thereof ranges from about (1–3):(2–1):(0.01–0.3).

15. The additive concentrate of claim 14 wherein the mole ratio of styrene:maleic anhydride:methacrylic acid or ester thereof is about 1:1:0.05.

16. The additive concentrate of claim 6 wherein the at least one amino compound is a polyamino compound.

17. The additive concentrate of claim 16 wherein the polyamino compound is selected from the group consisting of aminopropylmorpholine and dimethylaminopropyl amine.

18. The additive concentrate of claim 1 wherein the diluent consists essentially of hydrotreated naphthenic oil.

19. The additive concentrate of claim 1 wherein the diluent is a synthetic oil.

20. The additive concentrate of claim 19 wherein the synthetic oil is an ester, a polyalphaolefin oligomer or an alkylated benzene.

21. A lubricating oil composition comprising a major amount of an oil of lubricating viscosity and a minor amount of the additive concentrate of claim 1.

22. A lubricating oil composition comprising a major amount of an oil of lubricating viscosity and a minor amount of the additive concentrate of claim 6.

* * * * *